US008446319B2

(12) United States Patent
Parker et al.

(10) Patent No.: US 8,446,319 B2
(45) Date of Patent: May 21, 2013

(54) ELECTRONIC TRACKING SYSTEM

(75) Inventors: Evan Parker, Newsoms, VA (US); Bruce Hammond, Castro Valley, CA (US); Tom Molinaro, Pleasant Hill, CA (US); John MacKay, San Jose, CA (US)

(73) Assignee: Evan Parker, Newsoms, VA (US)

( * ) Notice: Subject to any disclaimer, the term of this patent is extended or adjusted under 35 U.S.C. 154(b) by 232 days.

(21) Appl. No.: 13/106,255

(22) Filed: May 12, 2011

(65) Prior Publication Data

US 2011/0304505 A1 Dec. 15, 2011

Related U.S. Application Data

(60) Provisional application No. 61/334,869, filed on May 14, 2010.

(51) Int. Cl.
*G01S 1/00* (2006.01)

(52) U.S. Cl.
USPC ..... 342/385

(58) Field of Classification Search
USPC ..... 342/385
See application file for complete search history.

(56) References Cited

U.S. PATENT DOCUMENTS

| | | | | |
|---|---|---|---|---|
| 4,976,442 | A * | 12/1990 | Treadway | 473/570 |
| 6,115,636 | A | 9/2000 | Ryan | |
| 7,300,367 | B1 | 11/2007 | Andol et al. | |
| 7,426,888 | B2 * | 9/2008 | Hunt | 102/513 |
| 2002/0010390 | A1 | 1/2002 | Guice | |
| 2003/0229383 | A1 * | 12/2003 | Whitehurst et al. | 607/60 |
| 2006/0142820 | A1 * | 6/2006 | Von Arx et al. | 607/60 |
| 2006/0213105 | A1 | 9/2006 | Cugliari | |
| 2010/0117906 | A1 * | 5/2010 | Miller et al. | 342/387 |
| 2011/0057042 | A1 * | 3/2011 | Duggan et al. | 235/492 |
| 2011/0148884 | A1 * | 6/2011 | Zeleny | 345/441 |

* cited by examiner

*Primary Examiner* — Harry Liu
(74) *Attorney, Agent, or Firm* — Fish & Associates, PC

(57) ABSTRACT

An ordnance usable against a living body, the ordnance having a tracking module with a transmitter that can use at least a portion of the body as an antenna. In preferred embodiments, the tracking module is releasably coupled to a carrier, and a pointed tip is disposed on at least one of the tracking module and the carrier. The module preferably includes a circuit that provides location information to the transmitter, and optionally provides additional information, including at least one of motion, compass, pressure, oxygen, and heart beat information. Transmission can occur at any suitable interval, including for example, at least three times during a ten minute period. The transmitter can optionally transmit a no heart beat signal, failure signal, and/or low battery signal. Preferred systems include a receiver that can send an interrogation signal, and the ordnance can include an interrogation receiving circuit for receiving interrogation signals.

11 Claims, 3 Drawing Sheets

ELECTRONIC TRACKING SYSTEM

This application claims priority to provisional patent application Ser. No. 61/334,869 filed May 14, 2010.

FIELD OF THE INVENTION

The field of the invention is electronic tracking systems.

BACKGROUND

When hunting animals, especially with bows and arrows, spears, harpoons and other shafted ordnance, it is often necessary to track an animal that has been shot over many hours. Tracking an animal through the use of a radio transmitter attached to the animal can be superior to other methods but has its own difficulties. If the antenna is external to the animal, the antenna can often be rubbed off on a tree, rendered non-functional by the animal falling down on top of the antenna, or by other movements of the animal. Such problems attend embodiments of U.S. Pat. No. 7,300,367 to Andol et al., for example, which teaches a tracking assembly having hooked barbs that enter the hide/skin of the animal, leaving a transmission module attached to the outside of the animal.

If the antenna is internal to the animal, then the signal is often so attenuated by the body that the signal is too weak to track. One cannot merely increase the signal power because (a) the drain on the battery would likely be too great, and (b) the degree of signal attenuation would vary so much depending upon placement of the shot, that some shot placements would result in an illegally strong signal. Such problems attend embodiments of U.S. Pat. No. 4,976,442 to Treadway et al., which teaches an arrow shaft mounted transmission module that is released from the shaft as the shaft enters the animal. Similar problems attend shots placed with a bullet rather than a shafted ordnance, both against hunted animals and in military or police operations where the ordnance is used against a human. As used herein, the term "animal" should be read to include a human.

Andol and Treadway, as well as any other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Looking to implanted medical devices for solutions provides many examples of small modules with integrated antennas that are placed within a body for diagnostic purposes. These implanted modules use a low power data transmission to an external monitoring device typically using the Medical Implant Communication Service (MICS) bands (401 MHz to 406 MHZ) or the Wireless Medical Telemetry bands (608 MHz to 614 MHz, 1395 MHz to 1400 MHz and 1427 MHz to 1432 MHz). Other frequencies commonly used are the 915 MHz and 2.45 GHz bands in the Industrial, Scientific and Medical Equipment (ISM) bands. It turns out, however, that such frequencies are not suitable for tracking animals because the transmissions are attenuated much too quickly in the body and over long distances at the low power needed to meet regulatory requirements.

The main reason for using a higher frequency is that the size of the antenna is smaller than for a lower frequency, since the length of the antenna is dependent on the wavelength of the RF signal. In general terms, as the frequency of an RF signal increases as the wavelength of that RF signal decreases.

More specifically, the wavelength of an RF signal is dependent on the frequency and the dielectric constant of the material through which the signal is travelling. Since the dielectric constant of dry air is relatively constant over frequencies up to 100 GHz, the wavelength of an RF signal in dry air is also relatively constant and easy to calculate. In contrast, the various tissues in a body each have different dielectric constants that are frequency dependent, so the wavelength of an RF signal travelling through a body varies with the different tissues it passes through and with the frequency of the signal, thus calculating the wavelength of an RF signal in a body requires knowing the dielectric constants of the various body tissues at the frequency of the RF signal and is usually reduced to an approximation using a composite equivalent dielectric constant for a typical body.

Another aspect of the frequency dependency of the dielectric constants of various body tissues is that the absorption of an RF signal by the body increases with frequency. For frequencies under about 4 MHz, the wavelength of the signal is significantly larger than the cross-section of a typical human body and there is very little effect on the signal. Above 4 MHz, the absorption of signal energy increases in proportion to the increase in frequency until the human body becomes essentially opaque to RF signals. And above about 1 GHz, the different dielectric properties of the various body tissues begin to cause diffraction and refraction of the RF signal at the tissue boundaries.

The frequency dependency of the dielectric constants of various body tissues also affects the efficiency of implanted antennas for medical applications, which typically only achieve an efficiency of 0.01% to 3% as compared to antennas out in the open air that can usually achieve 95% efficiency.

The higher the frequency, the higher the absorption by the body and the resulting loss of RF signal strength as it passes through a body. As a result, it is desirable to keep the frequency of transmissions for a tracking device as low as practical to reduce the attenuation of the RF signal by the body to which the tracking module is attached. The lower limit for a practical frequency is determined by the length of the antenna needed.

Since the conductivity differential between blood and other body tissues is typically at least 5:1, coupling an RF signal to the blood in the circulatory system, using a matching network to maximize signal transfer, will essentially use the blood as the conductor of a large area, lossy fractal antenna. The effective length of a circulatory system antenna would be dependent on the placement of the wireless device in the body relative to the extremities, but would be several orders of magnitude longer than any antenna that could be contained in (or on) the wireless device.

And while the transmission losses would be rather high, depending on the RF signal frequency and the dielectric constants of the surrounding tissues, the overall RF transmission efficiency should be at least as good as for antennas currently in use with implanted wireless devices.

Thus, there is still a need for an ordnance usable against a human or other animal, which provides a good tracking signal where the antenna is internal to the body.

SUMMARY OF THE INVENTION

The inventive subject matter provides apparatus, systems and methods in which an ordnance usable against a living body has a tracking module with a transmitter that can use at least a portion of the body as an antenna.

In preferred embodiments, the tracking module is releasably coupled to a carrier, and a pointed tip is disposed on at least one part of the tracking module and the carrier. The module preferably includes a circuit that provides location information to the transmitter, and optionally provides additional information, including at least one of motion, compass, pressure, oxygen, and heart beat information. Transmission can occur at any suitable interval, including for example, at least three times during a ten minute period. In some contemplated embodiments the transmitter can transmit a no heart beat signal, failure signal, low battery signal, and so forth.

Preferred systems include a receiver for receiving information from the transmitter. The received information can be provided to a user in any suitable manner, including for example, visually using a display screen and/or blinking light, or auditorily using a speaker or other sound producing component. In particularly preferred embodiments, the receiver could advantageously use a flashing indicator to show when the heart beats, and/or a numeric display to show the number of heart beats per minute.

It is further contemplated that the receiver could include a GPS (Global Satellite Positioning) chip, which could, for example, be used to assist other hunters in locating the person holding the receiver. Receivers could be specially designed or adapted equipment, or could even be a general-purpose cell phone, pda or other hand-held or vehicle-mounted device running an appropriate application to accomplish the functions described for the receiver herein. It is still further contemplated that using the GPS, the display could show the path taken by a targeted animal superimposed on a topographical display.

All suitable carriers are contemplated, including for example an arrow, a harpoon, a spear, a tranquilizer dart, and a crossbow bolt. The ordnance can advantageously include a release mechanism that releases the module from the carrier when the module is disposed within the body of the target animal. The module can be coupled to the carrier using an adhesive, a hook, a pressure fit mechanism, or any other suitable means. Where the carrier comprises a bullet casing, the module can advantageously compose the bullet, and the casing only carries the bullet until the bullet is fired from a gun. In such embodiments, the bullet performs functions similar to an arrow or other carrier.

From a method perspective, a method for tracking an animal comprises the steps of (1) shooting the animal with an ordnance that assists in determining a location of, and optionally a physiological characteristic of, the animal, and (2) that provides that information to a receiver using at least a portion of the animal's body as an antenna. Most preferably the tracking module makes use of the blood system of an animal as an antenna, using lower frequencies than would otherwise be practical with other types of antennas. In that way one can overcome the issues noted with previous methods of using an RF signal for the purpose of tracking an animal.

Various objects, features, aspects and advantages of the inventive subject matter will become more apparent from the following detailed description of preferred embodiments, along with the accompanying drawing figures in which like numerals represent like components.

DETAILED DESCRIPTION

In preferred embodiments, the ordnance includes a carrier and a tracking module. All suitable carriers are contemplated, including for example the shaft of an arrow, a spear, or a harpoon or a tranquilizer dart, and also bullets, which term is used herein to include slugs, and modules included among shot as in a shotgun shell. All suitable tracking modules are also contemplated, provided they have a suitable size, shape and composition. Since the tracking module is intended to enter the body, at least one part of the carrier and the tracking module must be sufficiently pointed to create a hole in the hide or skin and underlying tissue of the animal to allow entry of the carrier and tracking module into the body.

Figure 1:
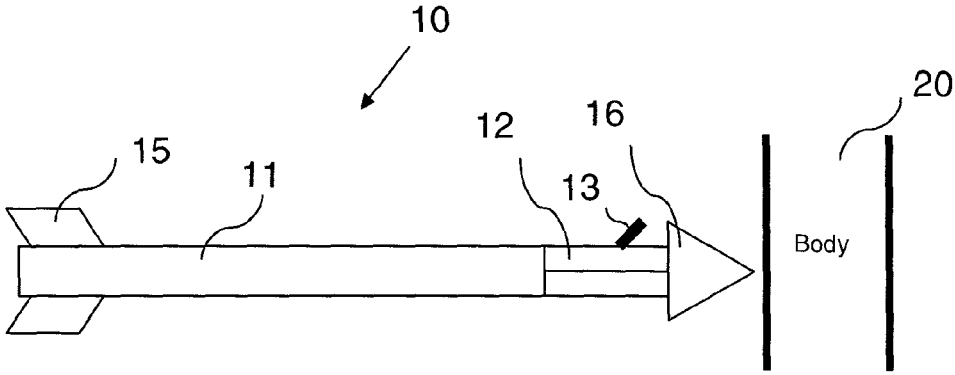
FIG. 1 is a schematic drawing of an ordnance having a tracking module, where the ordnance is about to enter a body of an animal.
Figure 2:
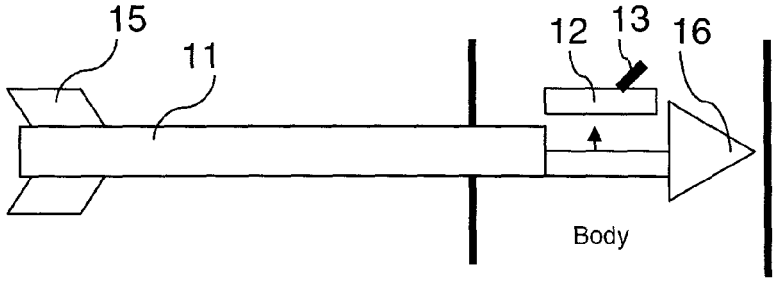
FIG. 2 is a schematic drawing of the ordnance of FIG. 1, in which the pointed end of the ordnance has entered the body, and the tracking module has been pulled away from the shaft.
Figure 3:
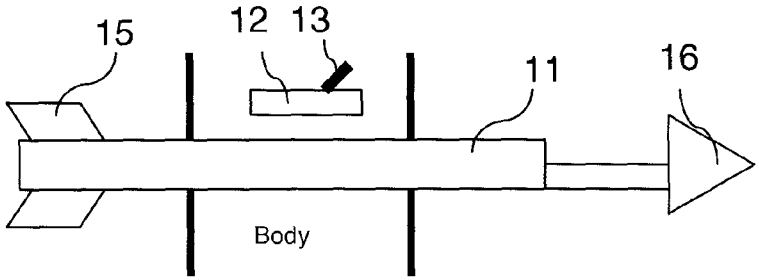
FIG. 3 is a schematic drawing of the ordnance of FIGS. 1 and 2, in which the shaft of the ordnance continues to pass into or through the body, and the tracking module remains in position within the body.

In FIGS. 1-3, a shafted ordnance 10, which should be generically considered to be any of an arrow, a spear, a harpoon, a tranquilizer dart, and a crossbow bolt, has a carrier 11 and a tracking module 12, and guides 15 and pointed head 16. FIGS. 1, 2, and 3 should be viewed as temporally successive snapshots of the ordnance about to enter the body, partially within the body, and then passing through the body.

The module is releasable from the carrier, which is apparent in FIG. 2. This particular embodiment uses a hook 13 as a release mechanism, which is engaged by the body to release the tracking module 12. In this usage, the hook should be considered generically to refer to any barb, lever or other appendage that sticks out from the carrier, and that is used to cause the release of the tracking module from the carrier as they enter the animal.

In FIG. 3, the carrier 11 is passing through the body. It should be apparent to those skilled in the art, however, that the carrier might not completely exit the body, as where the body portion entered is too thick, or the momentum of the carrier is too low, or the carrier strikes a hard object such as a bone.

Figure 4:
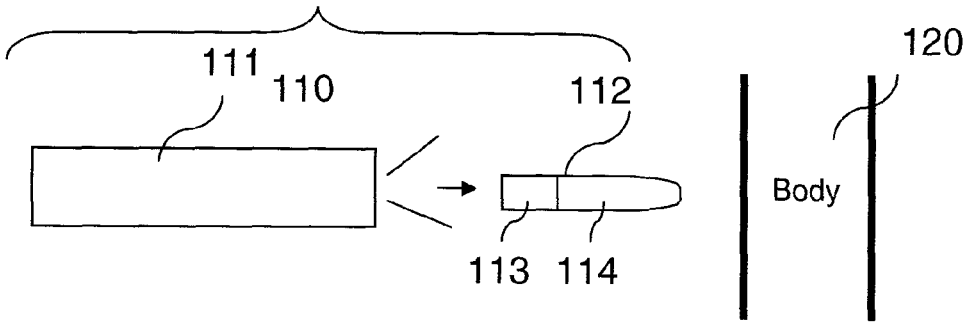
FIG. 4 is a schematic drawing of a bullet type of ordnance, the ordnance having a tracking module, and where the ordnance is about to enter a body of an animal.
Figure 5:
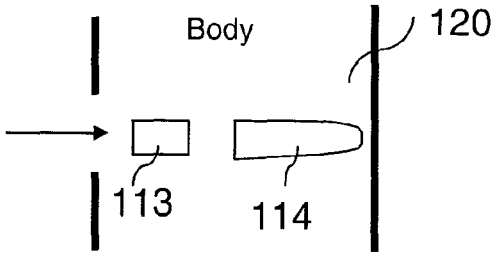
FIG. 5 is a schematic drawing of the ordnance of FIG. 4, in which the pointed component of the ordnance has entered the body, and the tracking module has been pulled away from the pointed component.
Figure 6:
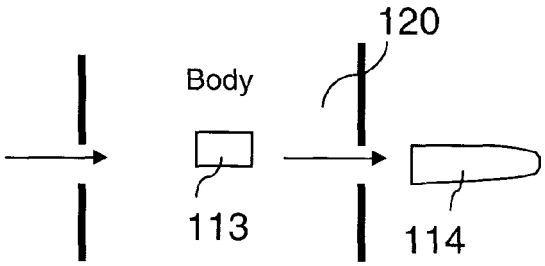
FIG. 6 is a schematic drawing of the ordnance of FIGS. 4 and 5, in which the pointed component of the ordnance continues to pass into or through the body, and the tracking module remains in position within the body.

In FIGS. 4-6, an ordnance 110 has a casing 111 and a bullet 112, which comprises a tracking module 113 and a pointed component 114. The bullet 112 (including the module 113) is released from the casing 111 upon firing. The bullet 112 enters the body 120, but of course in most instances the casing remains outside the body. Bodies 20 and 120 can be a body cavity or other portion of the body. Here again, the three figures represent successive snapshots of the ordnance about to enter the body, partially within the body, and then passing through the body. Although not shown in the figures, it is also contemplated that a bullet type of ordnance may either exit the body, or remain within the body. Additionally, the bullet, which could include the tracking module, could be slowed within the body by a flattening effect of the pointed component, and the pointed component might not exit the body.

Figure 7:
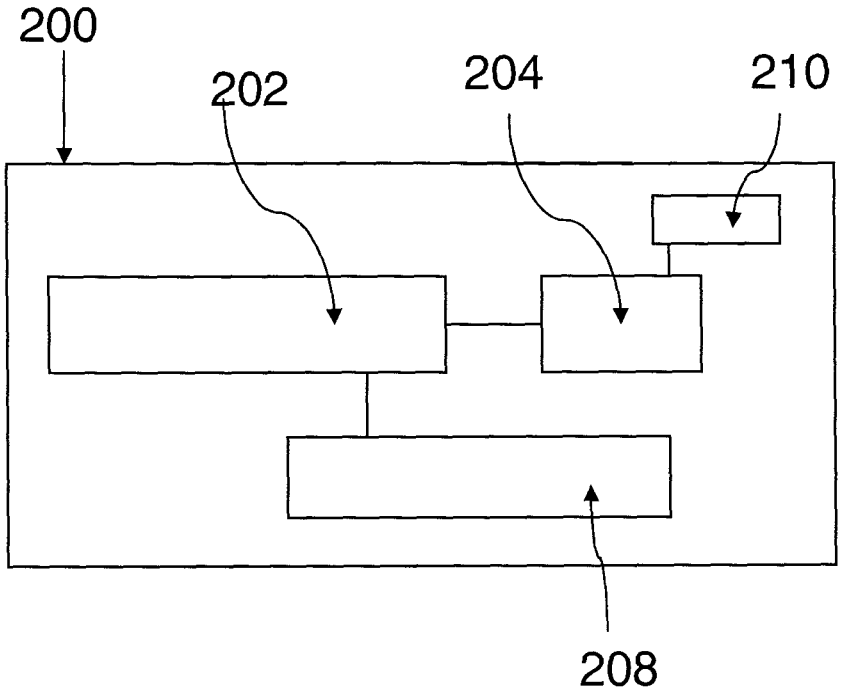
FIG. 7 is a schematic of a tracking system that includes a tracking module with transmission, processor circuit and battery, an optional sensor and an optional receiving circuit.

FIG. 7 shows a system that includes (1) a generic tracking module 200, which can correspond to component 12 in FIGS. 1-3 and component 113 in FIGS. 4-6; and a tracking module 200 that includes a transmission and processor circuit 202 and a battery 204. In this particular embodiment tracking module 200 also includes an optional sensor 208 and an optional receiving circuit 210.

From a method perspective, the inventive subject matter includes the steps of shooting a tracking module into an animal, where the tracking module has a sensor and a transmitter that can use a portion of the animal's body as an antenna to transmit a signal containing position information and information derived from a sensor. In preferred such embodiments the information reflects a physiological characteristic of the animal, as for example one or more of blood pressure, blood oxygen (PO2), and heart beat. Of particular interest in some embodiments is transmission of a "no heart beat" signal, indicating that the animal is likely dead. The heart beat information can also be used to determine when it is likely safe to approach the animal, as for example because the animal is sufficiently tranquilized.

Signal transmission can occur at any suitable interval(s) and duty cycle. The transmitter preferably transmits the location information at least three times during a ten minute period, more preferably at least five times during a ten minute period, most preferably at least ten times during a ten minute period. From another perspective, location signals are preferably transmitted over a period of at least two hours, more preferably at least five hours, still more preferably at least ten hours, and most preferably at least 24 hours. It is contemplated that signals could be transmitted at differing duty cycles. For example, a device could transmit every minute for the first hour, then every five minutes for the next two hours, and then every 10 minutes thereafter.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In addition to providing location and physiologic information, it is also contemplated that the transmitter could transmit other information, for example one or more of speed and compass (i.e., how fast the animal is moving and/or in what direction). Other contemplated sensors, and in FIG. 7 for example, can include an accelerometer and/or a microphone.

It is still further contemplated that the tracking module could include an interrogation receiving circuit. That would allow a user to transmit a signal, preferably from their monitoring device to the tracking module, with the signal interpreted as an instruction. Contemplated instructions include: (1) stopping or slowing or in some other manner altering transmissions from the tracking module, permanently or for some period of time; (2) altering the type of information being transmitted; and (3) releasing an electrical signal or a chemical into the body of the animal to paralyze, kill or otherwise affect the animal.

Tracking modules can advantageously include circuitry that adds identification information to the signal, or use some other feature to distinguish modules, such that two or more different tracking modules could be used in the same locale without confusing which animal is which on the user's monitoring device. Other contemplated features include use of different frequencies, or other signal characteristics.

As discussed above, the ordnance can be any suitable shafted weapon, including for example an arrow, a harpoon, a spear, and a crossbow bolt, where the carrier is the shaft and the module is carried by the shaft. For shafted weapons, it is advantageous to provide a release mechanism that releases the module from the shaft after at least a portion of the shaft has entered the body. Suitable release mechanisms include a simple hook such at that found on U.S. Pat. No. 4,976,442 discussed above, or a pressure fit mechanism. It is also contemplated that the release mechanism could be chemical, such as where the module is coupled to the carrier using an adhesive.

The ordnance can also be any suitable bullet, where the carrier is the bullet casing, and the tracking module is the component that is shot from the casing.

As used herein, the term "animal" should be interpreted as including a human being.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An ordnance usable against a living body, comprising:

a tracking module that includes a transmitter, wherein the transmitter can use at least a portion of the body as an antenna;

a carrier releasably coupled to the tracking module;

a pointed tip disposed on at least one part of the tracking module and the carrier; and wherein the carrier is selected from the group consisting of an arrow, a harpoon, a spear, and a crossbow bolt.

2. The ordnance of claim 1, further comprising a circuit that provides location information to the transmitter.

3. The ordnance of claim 1, wherein the transmitter transmits the location information at least three times during a ten minute period.

4. The ordnance of claim 1, further comprising a first sensor that provides at least one of motion, compass, pressure, oxygen, and heart beat information to the transmitter.

5. The ordnance of claim 4, further comprising a second sensor that provides at least one of motion, compass, pressure, oxygen, and heart beat information to the transmitter.

6. The ordnance of claim 4, wherein the transmitter transmits a no heart beat signal.

7. The ordnance of claim 1, wherein the module includes an interrogation receiving circuit.

8. The ordnance of claim 1, further comprising a release mechanism that releases the module from the carrier when the module is disposed within the body.

9. The ordnance of claim 1 wherein the module is coupled to the carrier using an adhesive.

10. The ordnance of claim 1 wherein the module is coupled to the carrier using a pressure fit mechanism.

11. The ordnance of claim 1 wherein the module is coupled to the carrier using a hook.

* * * * *